US009791167B2

(12) United States Patent
Gates

(10) Patent No.: US 9,791,167 B2
(45) Date of Patent: Oct. 17, 2017

(54) HEAT PUMP INSPECTION FACILITATING STAND DEVICE

(71) Applicant: Daniel N. Gates, Clear Lake, SD (US)

(72) Inventor: Daniel N. Gates, Clear Lake, SD (US)

( * ) Notice: Subject to any disclaimer, the term of this patent is extended or adjusted under 35 U.S.C. 154(b) by 298 days.

(21) Appl. No.: 14/587,121

(22) Filed: Dec. 31, 2014

(65) Prior Publication Data

US 2016/0187025 A1 Jun. 30, 2016

(51) Int. Cl.
*F24F 1/60* (2011.01)
*F24F 13/32* (2006.01)

(52) U.S. Cl.
CPC ..... *F24F 13/32* (2013.01); *F24F 1/60* (2013.01)

(58) Field of Classification Search
CPC ..... F24F 1/60; F24F 1/62; F24F 1/64; F24F 1/66; F24F 1/68; F24F 13/32; F16M 11/22; F16M 11/16; F16M 5/00; F16M 2200/08
USPC ..... 248/176.1, 676, 246.01, 346.02
See application file for complete search history.

(56) References Cited

U.S. PATENT DOCUMENTS 578,012 A * 3/1897 Harris ..... A61J 19/06 211/85.17
1,065,979 A * 7/1913 Spencer ..... B25B 1/20 217/36
2,377,415 A * 6/1945 Guignon, Jr. ..... B65D 9/04 248/176.1
2,940,599 A * 6/1960 Gentner ..... E04G 21/00 182/224
5,241,772 A * 9/1993 Hall ..... A01M 31/00 135/117
5,407,171 A * 4/1995 Gonzalez ..... F16M 5/00 248/670
6,541,685 B2 * 4/2003 Meinl ..... G10D 13/026 84/327
7,219,873 B2 * 5/2007 Harwood ..... E04H 12/2261 181/171
7,798,465 B1 * 9/2010 Meverden ..... F24F 13/0209 248/153
8,348,071 B1 * 1/2013 Janlert ..... F16M 5/00 211/175
8,827,232 B2 * 9/2014 Crowley ..... A47B 43/003 211/175
2005/0029426 A1 * 2/2005 Washick ..... A47G 33/126 248/523
2014/0075980 A1 * 3/2014 Villar ..... F24F 13/32 62/297
2015/0159337 A1 * 6/2015 Kellner ..... E04H 12/2215 248/156
2016/0097482 A1 * 4/2016 Kamhi ..... F16M 5/00 248/676

* cited by examiner

*Primary Examiner* — Ryan Kwiecinski

(57) ABSTRACT

A heat pump inspection facilitating stand device supports a heat pump housing in an elevated position to inhibit debris from collecting on the housing wherein inspection of the housing and heat pump machine is facilitated. The device includes a stiff planar base ring wherein the base ring is configured to support a heat pump thereon. Each of a plurality of legs is coupled to and extends downwardly from a bottom surface of the base ring such that the base ring is supported in an elevated position. Each of a plurality of feet is coupled to and extends from a respective bottom end of an associated one of the legs and is structured to define an aperture extending through the foot for receiving an anchor therethrough for anchoring each foot to a footing.

9 Claims, 3 Drawing Sheets

HEAT PUMP INSPECTION FACILITATING STAND DEVICE

BACKGROUND OF THE DISCLOSURE

Field of the Disclosure

The disclosure relates to stand devices and more particularly pertains to a new stand device for supporting a heat pump housing in an elevated position to inhibit debris from collecting on the housing wherein inspection of the housing and heat pump is facilitated.

Summary of the Disclosure

An embodiment of the disclosure meets the needs presented above by generally comprising a stiff planar base ring wherein the base ring is configured to support a heat pump thereon. Each of a plurality of legs is coupled to and extends downwardly from a bottom surface of the base ring such that the base ring is supported in an elevated position. Each of a plurality of feet is coupled to and extends from a respective bottom end of an associated one of the legs and is structured to define an aperture extending through the foot for receiving an anchor therethrough for anchoring each foot to a footing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
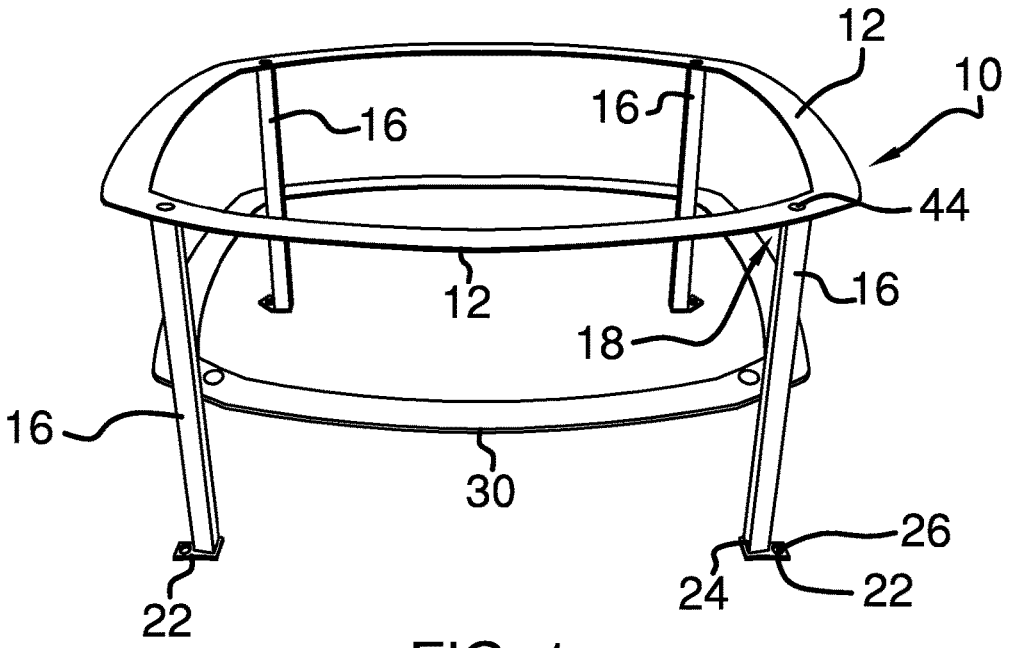
FIG. 1 is a top front perspective view of an heat pump inspection facilitating stand device according to an embodiment of the disclosure.
Figure 2:
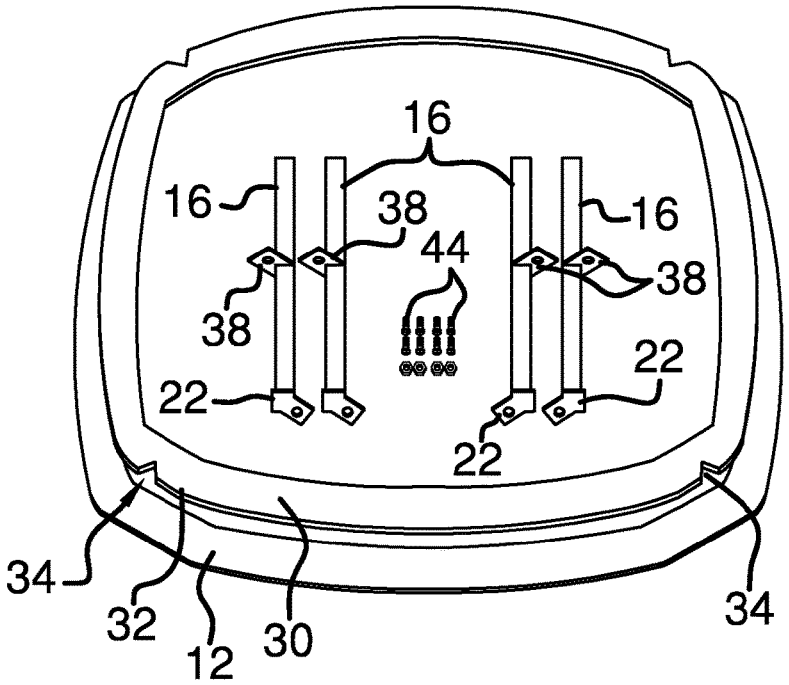
FIG. 2 is an exploded top front side perspective view of an embodiment of the disclosure.
Figure 3:
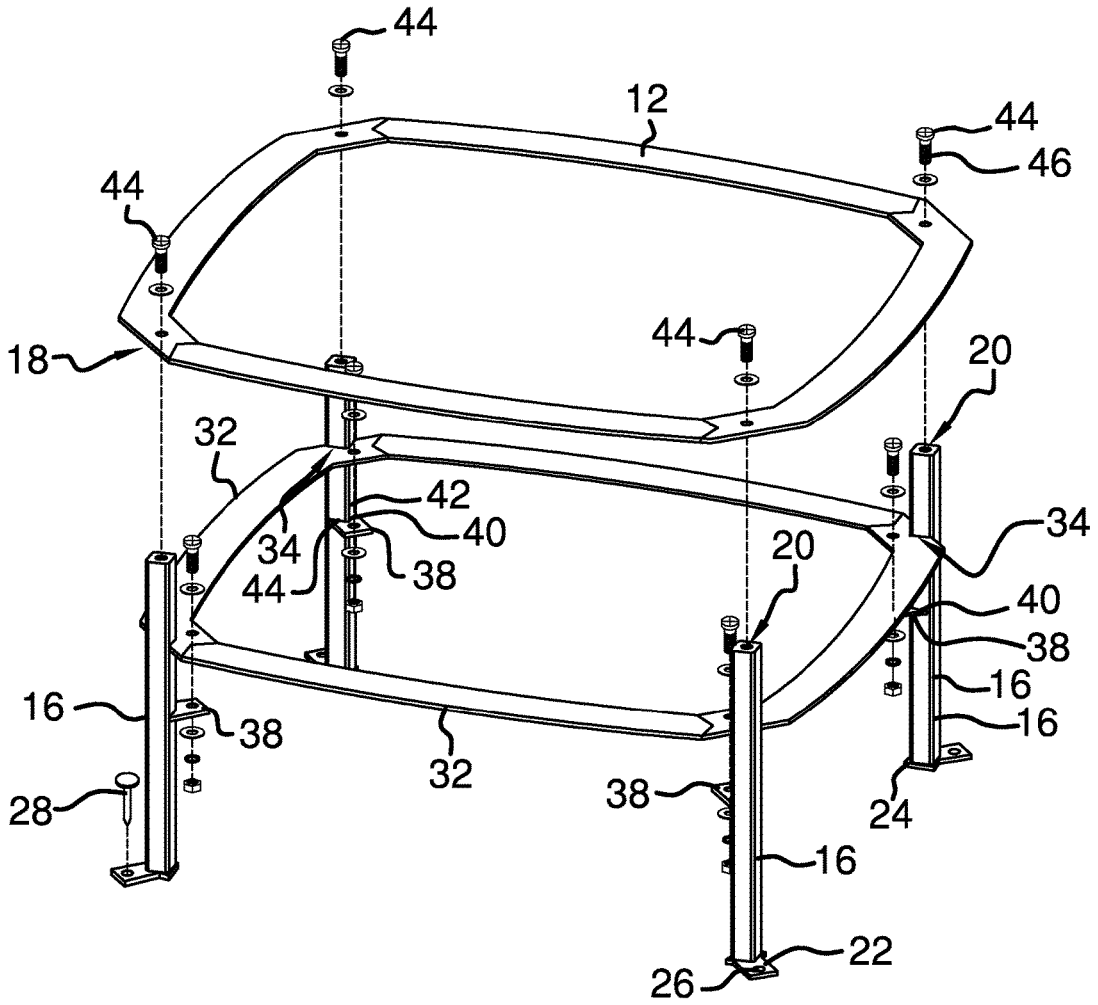
FIG. 3 is a top front side perspective view of an embodiment of the disclosure in use.
Figure 4:
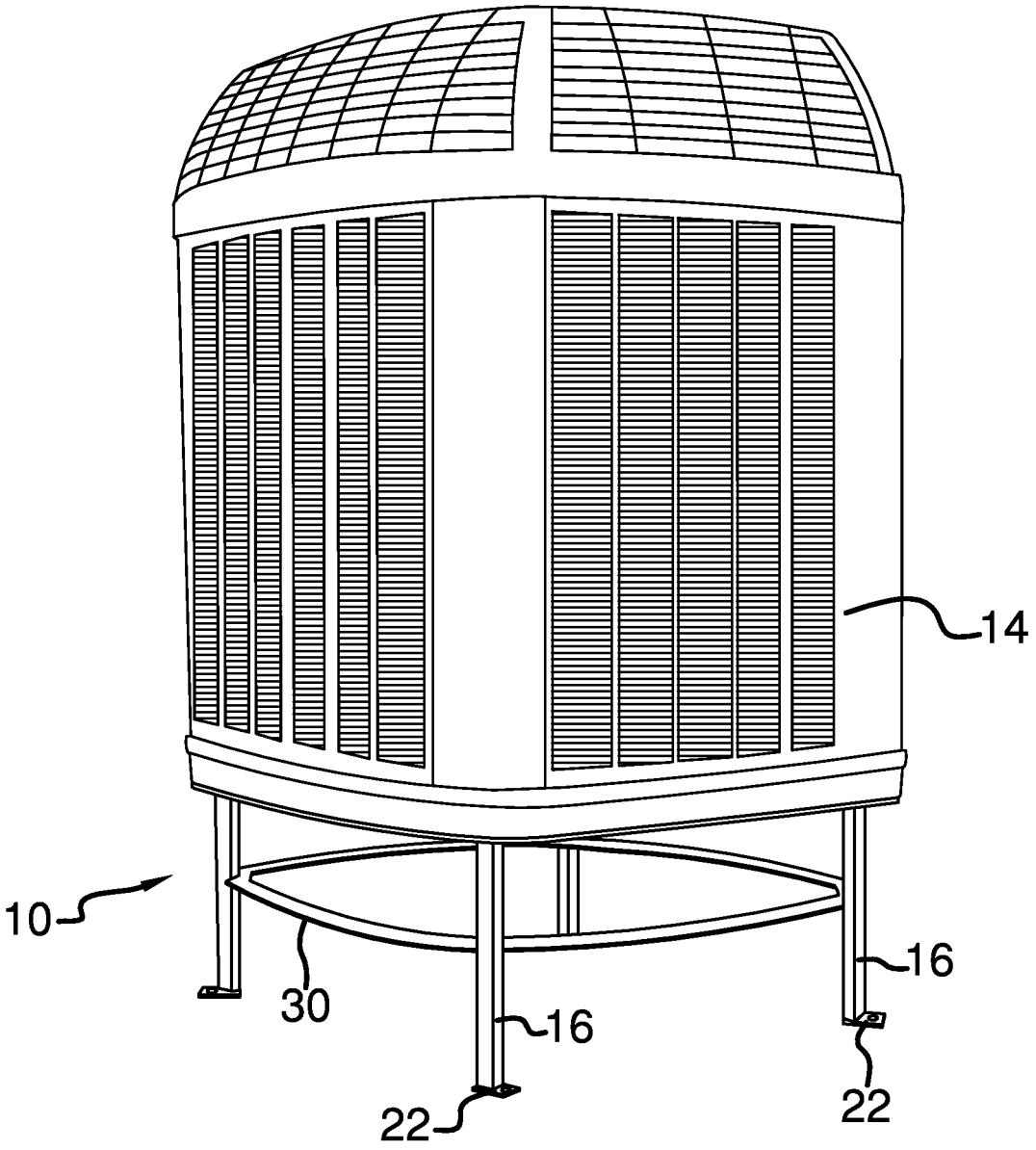
FIG. 4 is a top front perspective view of an embodiment of the disclosure in an unassembled state.

With reference now to the drawings, and in particular to FIGS. 1 through 4 thereof, a new stand device embodying the principles and concepts of an embodiment of the disclosure and generally designated by the reference numeral 10 will be described.

As best illustrated in FIGS. 1 through 4, the heat pump inspection facilitating stand device 10 generally comprises a base ring 12 which is planar. The base ring 12 is stiff wherein the base ring 12 is configured to support a heat pump 14, or the like, thereon. Each of a plurality of legs 16 is coupled to and extends downwardly from a bottom surface 18 of the base ring 12 such that the base ring 12 is supported in an elevated position. Each of the legs 16 is square shaped transverse to a longitudinal axis of the leg 16. Each leg 16 is structured to comprise a respective threaded top opening 20 extending into the leg 16.

Each of a plurality of feet 22 is coupled to and extends from a respective bottom end 24 of an associated one of the legs 16. Each of the feet 22 is structured to define an aperture 26 extending through the foot 22 wherein each foot 22 is configured for receiving an anchor 28 therethrough for anchoring each foot 22 to a footing. A brace 30 is coupled to each of the legs 16 in spaced relationship to the base ring 12 such that the brace 30 inhibits pivoting of each leg 16 relative to the base ring 12. The brace 30 is annular. The brace 30 has an outer peripheral edge 32. The outer peripheral edge 32 is structured to comprise a plurality of notches 34 extending into the outer peripheral edge 32. Each of the notches 34 is positioned to receive an associated one of the legs 16 wherein the outer peripheral edge 32 of the brace 30 abuts each leg 16 and inhibits lateral movement of each of the legs 16. Each notch 34 is triangular to extend along two adjacent sides of the associated leg 16.

Each of a plurality of flanges 38 is coupled to and extends from an associated one of the legs 16. The brace 30 is coupled to each flange 38. Each of the flanges 38 is oriented parallel to the base ring 12 and each of the flanges 38 extends perpendicularly from the associated leg 16 and towards a central axis of the base ring 12. Each flange 38 has a pair tapered edges 40 coupled to the associated leg 16 such that each flange 38 extends from a corner 42 of the associated leg 16.

Each of a plurality of fasteners 44 has a threaded shaft 46 complementary to the threaded top opening 20 of the legs 16 wherein the fasteners 44 are couplable to the legs 16 by threaded insertion into the threaded top opening 20 of an associated one of the legs 16 Thus, the fastener 44 secures the base ring 12 to the associated leg 16. Each of the base ring 12, the legs 16, and the brace 30 is constructed of a metal material or the like to be durable and sturdy to support the heat pump 14 thereon.

In use, the device 10 supports the heat pump 14 in an elevated position preventing debris from accumulating adjacent to a bottom of the heat pump. The substantially open sides of the device 10 facilitate viewing an underside of the heat pump for possible debris accumulation or blockages of air flow detrimental to operation of the heat pump 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A heat pump inspection facilitating stand device comprising:

a base ring, said base ring being planar, said base ring being configured to support a heat pump thereon;

a plurality of legs, each of said legs being coupled to and extending downwardly from a bottom surface of said base ring such that said base ring is supported in an elevated position;

a plurality of feet, each said foot being coupled to and extending from a respective bottom end of an associated one of said legs, each of said feet being structured to define an aperture extending through said foot wherein each said foot is configured for receiving an anchor therethrough for anchoring each said foot to a footing;

a brace coupled to each of said legs in spaced relationship to said base ring such that said brace inhibits pivoting of each said leg relative to said base ring, said brace being annular; and a plurality of flanges, each said flange being coupled to and extending from an associated one of said legs, said brace being coupled to each said flange.

2. The device of claim 1, further comprising each of said flanges being oriented parallel to said base ring, and each of said flanges extending perpendicularly from said associated leg and towards a central axis of said base ring.

3. The device of claim 1, further comprising:

each said leg being structured to comprise a threaded top opening extending into said leg; and a plurality of fasteners, each said fastener having a threaded shaft complementary to said threaded top opening of said legs wherein said fasteners are couplable to said legs by threaded insertion into said threaded top opening of an associated one of said legs.

4. The device of claim 1, further comprising each of said base ring and said legs being constructed of a metal material.

5. The device of claim 1, further comprising each of said base ring, said legs, and said brace being constructed of a metal material.

6. A heat pump inspection facilitating stand device comprising:

a base ring, said base ring being planar, said base ring being configured to support a heat pump thereon;

a plurality of legs, each of said legs being coupled to and extending downwardly from a bottom surface of said base ring such that said base ring is supported in an elevated position;

a plurality of feet, each said foot being coupled to and extending from a respective bottom end of an associated one of said legs, each of said feet being structured to define an aperture extending through said foot wherein each said foot is configured for receiving an anchor therethrough for anchoring each said foot to a footing;

a brace coupled to each of said legs in spaced relationship to said base ring such that said brace inhibits pivoting of each said leg relative to said base ring, said brace being annular, said brace having an outer peripheral edge, said outer peripheral edge being structured to comprise a plurality of notches extending into said outer peripheral edge, each of said notches being positioned to receive an associated one of said legs wherein said outer peripheral edge of said brace abuts each said leg and inhibits lateral movement of each of said legs.

7. The device of claim 6, further comprising:

each of said legs being square shaped transverse to a longitudinal axis of said leg; and each said notch being triangular.

8. The device of claim 7, further comprising each said flange having a pair tapered edges coupled to said associated leg such that each said flange extends from a corner of said associated leg.

9. A heat pump inspection facilitating stand device comprising:

a base ring, said base ring being planar, said base ring being configured to support a heat pump thereon;

a plurality of legs, each of said legs being coupled to and extending downwardly from a bottom surface of said base ring such that said base ring is supported in an elevated position, each of said legs being square shaped transverse to a longitudinal axis of said leg, each said leg being structured to comprise a threaded top opening extending into said leg;

a plurality of feet, each said foot being coupled to and extending from a respective bottom end of an associated one of said legs, each of said feet being structured to define an aperture extending through said foot wherein each said foot is configured for receiving an anchor therethrough for anchoring each said foot to a footing;

a brace coupled to each of said legs in spaced relationship to said base ring such that said brace inhibits pivoting of each said leg relative to said base ring, said brace being annular, said brace having an outer peripheral edge, said outer peripheral edge being structured to comprise a plurality of notches extending into said outer peripheral edge, each of said notches being positioned to receive an associated one of said legs wherein said outer peripheral edge of said brace abuts each said leg and inhibits lateral movement of each of said legs, each said notch being triangular;

a plurality of flanges, each said flange being coupled to and extending from an associated one of said legs, said brace being coupled to each said flange, each of said flanges being oriented parallel to said base ring, and each of said flanges extending perpendicularly from said associated leg and towards a central axis of said base ring, each said flange having a pair tapered edges coupled to said associated leg such that each said flange extends from a corner of said associated leg;

a plurality of fasteners, each said fastener having a threaded shaft complementary to said threaded top opening of said legs wherein said fasteners are couplable to said legs by threaded insertion into said threaded top opening of an associated one of said legs; and each of said base ring, said legs, and said brace being constructed of a metal material.

* * * * *